US011041447B2

(12) United States Patent
Parotto et al.

(10) Patent No.: US 11,041,447 B2
(45) Date of Patent: Jun. 22, 2021

(54) METHOD TO CONTROL A HIGH-PRESSURE FUEL PUMP FOR A DIRECT INJECTION SYSTEM

(71) Applicant: MARELLI EUROPE S.p.A., Corbetta (IT)

(72) Inventors: Marco Parotto, Bologna (IT); Matteo De Cesare, Torremaggiore (IT); Marco Morelli, Baschi (IT); Giovanni Prodi, Bologna (IT); Tommaso Cardellini, Corbetta (IT)

(73) Assignee: MARELLI EUROPE S.p.A., Corbetta (IT)

( * ) Notice: Subject to any disclaimer, the term of this patent is extended or adjusted under 35 U.S.C. 154(b) by 0 days.

(21) Appl. No.: 16/927,551

(22) Filed: Jul. 13, 2020

(65) Prior Publication Data

US 2021/0017916 A1 Jan. 21, 2021

(30) Foreign Application Priority Data

Jul. 18, 2019 (IT) ..... 102019000012300

(51) Int. Cl.
*F02D 41/38* (2006.01)
*F02D 1/00* (2006.01)
*F02M 55/02* (2006.01)

(52) U.S. Cl.
CPC ..... *F02D 1/00* (2013.01); *F02D 41/3836* (2013.01); *F02M 55/025* (2013.01); *F02D 2041/389* (2013.01); *F02D 2200/0602* (2013.01); *F02D 2200/0614* (2013.01); *F02D 2200/101* (2013.01)

(58) Field of Classification Search
CPC .. F02D 1/00; F02D 41/3836; F02D 2041/389; F02D 2200/0602; F02D 2200/101; F02D 2200/0614; F02M 55/025
USPC ..... 123/446, 456, 457, 495, 497, 498, 499, 123/491; 701/112, 113
See application file for complete search history.

(56) References Cited

U.S. PATENT DOCUMENTS

2018/0087479 A1 3/2018 Bean et al.

FOREIGN PATENT DOCUMENTS

EP 3244047 A1 11/2017

OTHER PUBLICATIONS

Search Report for Italian Patent Application No. 201900012300 dated Mar. 27, 2020.

*Primary Examiner* — Hai H Huynh
(74) *Attorney, Agent, or Firm* — Howard & Howard Attorneys PLLC

(57) ABSTRACT

The invention relates to a method to control a fuel pump for a direct injection system of a heat engine provided with a common rail comprising the steps of determining a minimum threshold based on the pressure in the common rail and on the speed of the heat engine, on the temperature of the high-pressure pump and on the inlet pressure of the high-pressure pump; calculating the objective fuel flow rate to be fed by the high-pressure pump to the common rail instant by instant in order to have the desired pressure value inside the common rail; comparing the objective fuel flow rate with the minimum threshold; and controlling the high-pressure pump based on the comparison between the objective fuel flow rate and the minimum threshold.

15 Claims, 3 Drawing Sheets

METHOD TO CONTROL A HIGH-PRESSURE FUEL PUMP FOR A DIRECT INJECTION SYSTEM

CROSS-REFERENCE TO RELATED APPLICATIONS

This patent application claims priority from Italian patent application no. 102019000012300 filed on Jul. 18, 2019, the entire disclosure of which is incorporated herein by reference.

TECHNICAL FIELD

The invention relates to a method to control a fuel pump for a direct injection system. Preferably (though not necessarily), the control method is used for a direct injection system in a spark-ignition internal combustion engine, which, thus, works with gasoline or similar fuels.

PRIOR ART

As it is known, a fuel—in this specific case gasoline—direct injection system of the common rail type for an internal combustion heat engine comprises a plurality of injectors, a common rail, which feeds pressurized fuel to the injectors, a high-pressure pump, which feeds fuel to the common rail and is provided with a flow rate adjusting device, a control unit, which causes the fuel pressure inside the common rail to be equal to a desired value, which generally varies in time depending on the engine operating conditions, and a low-pressure pump, which feeds fuel from a tank to the high-pressure pump by means of a feeding duct.

The control unit is coupled to the flow rate adjusting device so as to control the flow-rate of the high pressure pump, so that the common rail is supplied, instant by instant, with the amount of fuel needed to have the desired pressure value in the common rail; in particular, the control unit adjusts the flow rate of the high pressure pump by means of a feedback control, which uses, as a feedback variable, the value of the fuel pressure inside the common rail.

The operating cycle of the high pressure pump substantially comprises three phases: an intake phase, in which to allow the passage of a fuel flowing into a pumping chamber of the high-pressure pump; a reflux phase, during which a respective intake valve is kept open and there is a passage of fuel flowing out of the pumping chamber towards the low-pressure circuit; and a pumping phase, during which the respective intake valve closes and the fuel pressure inside the pumping chamber reaches a values that is such as to cause a fuel flow flowing out of the pumping chamber towards the common rail.

Experiments have shown that, during the pumping phase, there is a significant increase in the temperature of the high-pressure pump. In particular, when there is a pressure increase from 200 to 600 bar, the temperature variation ranges from 30 to 50° C. in the different points of the high-pressure pump, whereas, in case there is a pressure increase from 600 to 800 bar, the temperature variation assumes much more significant values in the range of 80° C. A temperature variation ranging from 30 to 50° C. could already lead to cavitation problems, which cause the high-pressure pump to become unstable and scarcely reliable, namely incapable of making sure that the common rail is supplied, instant by instant, with the quantity of fuel needed to reach the desired pressure value inside the common rail.

It has been proved that this phenomenon worsens in case the high pressure pump does not work with a full load, i.e. in case the fuel quantity needed to have the desired pressure value inside the common rail and fed by the high pressure pump is lower than the maximum flow rate that can be delivered by the high-pressure pump. In case the high-pressure pump operates with a full load (namely, in case the fuel quantity needed to have the desired pressure value inside the common rail and fed by the high-pressure pump is equal to the maximum flow rate that can be delivered by the high-pressure pump), the heat generated during the pumping phase is removed through the fuel flow rate flowing out of the high-pressure pump and the removal of the heat generated during the pumping phase is proportional to the fuel flow rate flowing of the high-pressure pump.

Furthermore, in case the high-pressure pump does not operate with a full load, but with a partial load, the operation of the high-pressure pump is characterized by negative effects, in particular in terms of energy efficiency, and by potential damaging risks.

In particular, the energy used (and, as a consequence, the heat generated) during the compression phase is proportional to the mass of fuel trapped by the respective intake valve (considering both the adjusted fuel flow rate and the dead volume), whereas the heat removed is proportional to the sole flow rate delivered (since the dead volume does not flow out of the high-pressure pump and, clearly, cannot disperse heat). As a consequence, the smaller the flow rate delivered, the greater the thermal overload. The useful energy transmitted by the system to the fuel is also proportional to the sole flow rate delivered.

On the other hand, as far as the potential damaging risks of the high-pressure pump are concerned, closing the intake valve far from the top dead centre and from the bottom dead centre of the high-pressure pump, namely when the speed of the piston of the pump is other than zero and when the engine operates at a high speed, leads to quick and significant pressure increases, which cause, in turn, mechanical oscillations with consequent potential damaging risks.

In order to avoid the triggering of cavitation phenomena or the damaging of the high-pressure pump, different solutions were suggested over the years, which, in particular, are aimed at limiting the temperature increase of the high-pressure pump during the pumping phase.

For instance, in order to solve the cavitation problem, it is possible to increase the pressure of the fuel flowing into the high-pressure pump, but this solution is also affected by negative effects in terms of energy efficiency. Alternatively, the high-pressure pump can be provided with a fuel recirculation circuit, which is provided with a draining duct, which transfers a fuel portion from the pumping chamber to the tank, so that the heat generated during the pumping phase is disposed of through the fuel flow rate flowing out of the high-pressure pump; this technical solution, though, suffers from significant drawbacks in terms of overall dimensions of the injection system and is disadvantageous from and economic point of view.

DESCRIPTION OF THE INVENTION

Therefore, the object of the present invention is to provide a method to control a fuel pump for a direct injection system, said method not suffering from the drawbacks described above and, in particular, being easy and economic to be implemented.

According to the invention, there is provided a method to control a fuel pump for a direct injection system according to the appended claims.

BRIEF DESCRIPTION OF THE DRAWINGS

The invention will now be described with reference to the accompanying drawings, showing a non-limiting embodiment thereof, wherein.

PREFERRED EMBODIMENTS OF THE INVENTION

Figure 1:
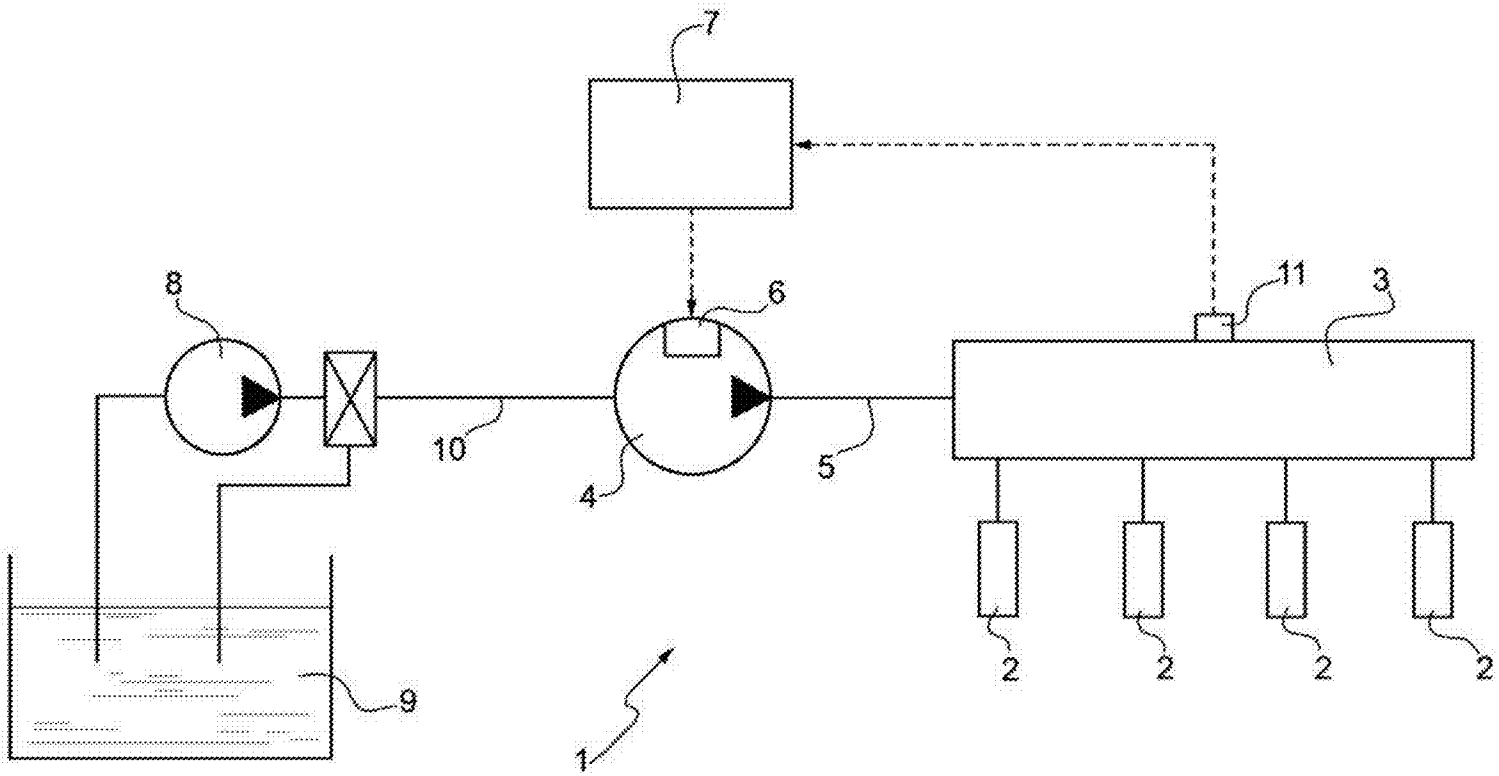
FIG. 1 is a schematic view, with some details removed for greater clarity, of a fuel direct injection system.

In FIG. 1, number 1 indicates, as a whole, a fuel direct injection system, in particular using gasoline as a fuel, of the common rail type for an internal combustion engine.

The direct injection system 1 comprises a plurality of injectors 2, a common rail 3, which feeds fuel under pressure to the injectors 2, a high-pressure pump 4, which feeds fuel to the common rail 3 by means of a feeding duct 5 and is provided with a flow rate adjusting device 6, an electronic control unit 7, which causes the fuel pressure inside the common rail 3 to be equal to a desired value, which generally varies in time depending on the engine operating conditions, and a low-pressure pump 8, which feeds fuel from a tank 9 to the high-pressure pump 4 by means of a feeding duct 10.

The electronic control unit 7 is coupled to the flow rate adjusting device 6 so as to control the flow rate of the high-pressure pump 4 in order to feed to the common rail 3, instant by instant, the quantity of fuel needed to have the desired pressure value inside the common rail 3. Furthermore, the electronic control unit 7 is connected to a pressure sensor 11, which detects in real time the fuel pressure $P_{RAIL}$ inside the common rail 3.

Hereinafter we will describe the strategy implemented by the electronic control unit 7 to control the high-pressure pump 4.

Figure 2:
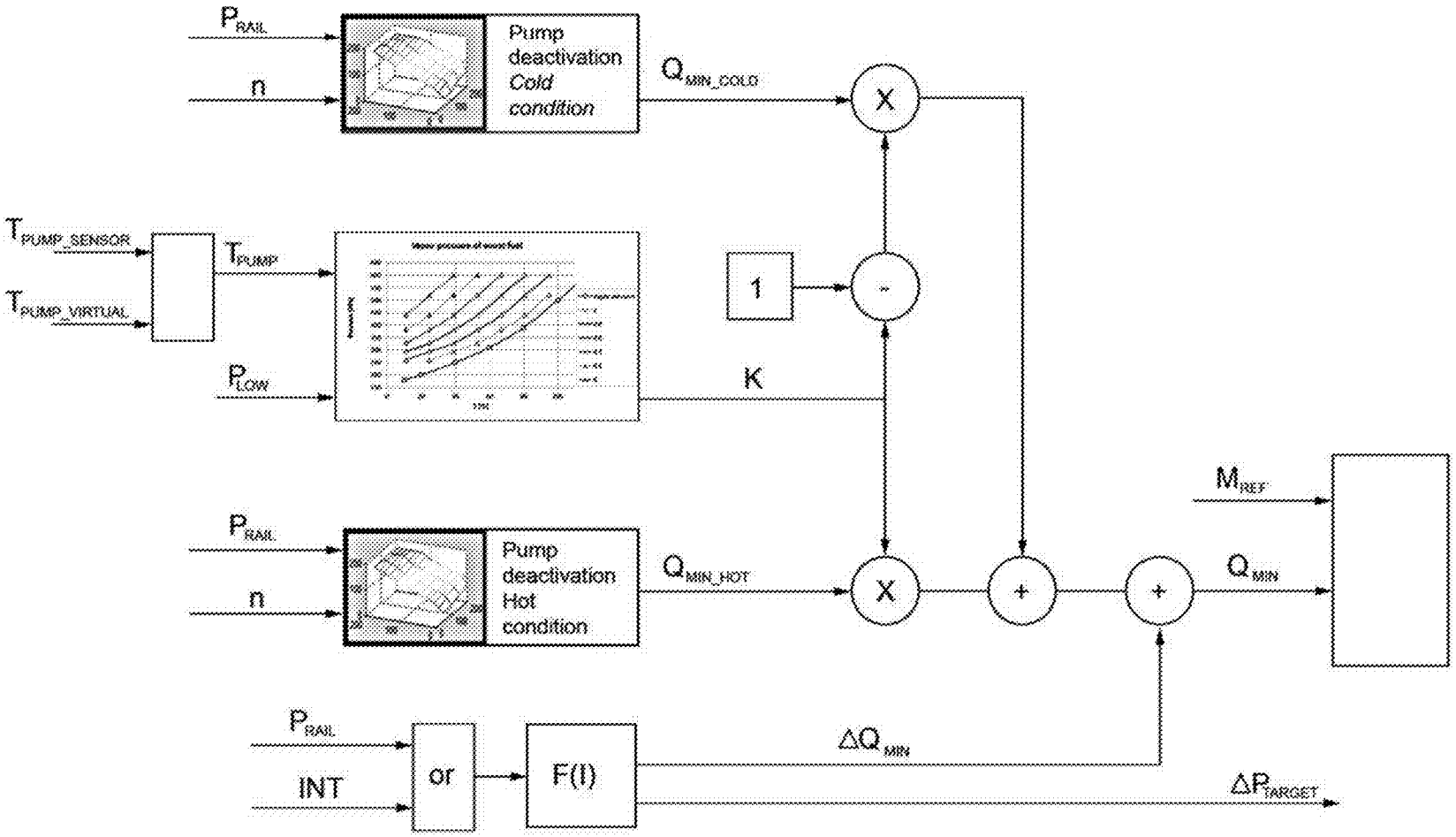
FIG. 2 is a block diagram showing a first variant of the operating logic of the method according to the invention.

The strategy entails determining a minimum threshold $Q_{MIN}$ of fuel to be pumped with every operating cycle of the high-pressure pump 4, according to FIG. 2.

The minimum threshold $Q_{MIN}$ is basically determined based on a plurality of parameters, such as pressure $P_{RAIL}$ in the common rail 3 detected by means of the pressure sensor 11, temperature $T_{PUMP}$ of the high-pressure pump 4, inlet pressure $P_{LOW}$ of the high-pressure pump 4, speed n of the heat engine 1 and engine load C.

The temperature $T_{PUMP}$ of the high-pressure pump 4 can either be detected by means of a dedicated temperature sensor housed on the high-pressure pump 4 ($T_{PUMP_SENSOR}$) or be estimated by means of an estimation model ($T_{PUMP_VIRTUAL}$).

More in detail, inside the electronic control unit 7 there is stored a map COLD, which provides an (open loop) contribution $Q_{MIN_COLD}$ to determine the minimum threshold $Q_{MIN}$. The contribution $Q_{MIN_COLD}$ represents the minimum threshold of fluid to be pumped under cold conditions, i.e. under conditions that are far from the triggering of cavitation phenomena for given values of the pressure $P_{RAIL}$ in the common rail 3 and of the speed n of the heat engine 1. Indeed, the map COLD receives, as an input, the values of the pressure $P_{RAIL}$ in the common rail 3 and of the speed n of the heat engine 1, respectively, and, based on said input values, provides the contribution $Q_{MIN_COLD}$.

Similarly, inside the electronic control unit there is stored a further map HOT, which provides an (open loop) contribution $Q_{MIN_HOT}$ to determine the minimum threshold $Q_{MIN}$. The contribution $Q_{MIN_HOT}$ represents the minimum threshold of fluid to be pumped under hot conditions, i.e. under conditions that are close to the triggering of cavitation phenomena for given values of the pressure $P_{RAIL}$ in the common rail 3 and of the speed n of the heat engine 1.

Finally, inside the electronic control unit 7 there is stored a map VAPOR PRESSURE, which provides a coefficient K (expressed as percentage), which is also used to determine the minimum threshold $Q_{MIN}$. The map VAPOR PRESSURE receives, as an input, the values of the inlet pressure $P_{LOW}$ of the high-pressure pump 4 (also known as "low pressure") and of the temperature $T_{PUMP}$ of the high-pressure pump 4, respectively, the latter being expressed either by the temperature ($T_{PUMP_SENSOR}$) detected by means of the temperature sensor housed on the high-pressure pump 4 or by the temperature ($T_{PUMP_VIRTUAL}$) estimated by means of an estimation model. Said map VAPOR PRESSURE contains the curves of the fuel vapour pressure depending on the temperature $T_{PUMP}$ of the high-pressure pump 4. Based on the temperature $T_{PUMP}$ of the high-pressure pump 4 and on the inlet pressure $P_{LOW}$ of the high-pressure pump 4, the map VAPOR PRESSURE provides said coefficient K, which expresses (as a percentage) how far or close the high-pressure pump 4 is from or to the condition of triggering of cavitation phenomena.

Therefore, the minimum threshold $Q_{MIN}$ is calculated as follows:

$$Q_{MIN}=(1-K)*Q_{MIN_COLD}+K*Q_{MIN_HOT} \quad [1]$$

$Q_{MIN}$ minimum threshold;

K coefficient;

$Q_{MIN_COLD}$ "cold" contribution of the minimum threshold; and $Q_{MIN_HOT}$ "hot" contribution of the minimum threshold.

It is evident that, for example, a value of the coefficient K equal to 1 provided by the map VAPOR PRESSURE indicates that the high-pressure pump 4 is working under conditions that are close to the triggering of cavitation phenomena; on the other hand, a value of the coefficient K equal to 0 or to 0.2 provided by the map VAPOR PRESSURE indicates that the high-pressure pump 4 is working under conditions that are very far from the triggering of cavitation phenomena.

Furthermore, it should be pointed out that both inside the map COLD providing the contribution $Q_{MIN_COLD}$ and inside the map HOT providing the contribution $Q_{MIN_HOT}$ to determine the minimum threshold $Q_{MIN}$ there are embedded both the contribution to increase the energy efficiency and the contribution to decrease potential damaging risks.

In other words, both the contribution $Q_{MIN_COLD}$ and the contribution $Q_{MIN_HOT}$ are determined so as to contain the temperature variation of the high-pressure pump 4 and, simultaneously, increase the energy efficiency and decrease potential damaging risks.

According to a preferred embodiment, the strategy entails determining an energy index I, which gives an indication of the closeness—or lack thereof—to the triggering of cavitation phenomena of the high-pressure pump 4. The energy index I is preferably based on the intensity of the perturbation of the signal concerning the pressure $P_{RAIL}$ in the common rail 3 detected in real time by the pressure sensor 11. Said perturbation is assessed by means of an integral within an observation time window between time instants $t_1$ and $t_2$, as described more in detail below.

According to a first variant, the energy index $I_1$ is expressed as follows:

$$I_1=\int_{t_1}^{t_2}(P_{TARGET}-P_{RAIL})^2dt \quad [2]$$

According to a second variant, the energy index $I_2$ is expressed as follows:

$$I_2=\int_{t_1}^{t_2}(P_{RAIL_M}-P_{RAIL})^2dt \quad [3]$$

According to a third variant, the energy index $I_3$ is expressed as follows:

$$I_3=\int_{t_1}^{t_2}(INT_M-INT)^2dt \quad [4]$$

wherein:

$t_1$, $t_2$ instants defining an observation time window;

$P_{RAIL}$ actual pressure in the common rail 3;

$P_{TARGET}$ pressure target in the common rail 3;

$P_{RAIL_M}$ actual mean pressure in the common rail 3 and within the observation window;

INT value of the integral component of the closed loop of the pressure control;

$INT_M$ mean value of the integral component of the closed loop of the pressure control within the observation window.

The indexes $I_1$ and $I_2$ are clearly calculated in case the objective fuel flow rate $M_{ref}$ is delivered (as described more in detail below), namely under "normal" operating conditions (without deactivation).

The energy index I is used inside the electronic control unit 7 to obtain an adaptive function aimed at optimizing the strategy, so that it can be adapted to high-pressure pumps 4 with different production tolerances.

In particular, the adaptive function entails storing a threshold value inside the electronic control unit 7. The threshold value preferably is variable based on the load (and, namely, on the injected fuel quantity $Q_{F_INJ}$). The threshold value preferably is variable also based on the speed n of the heat engine. Furthermore, the threshold value is variable based on the difference between the quantity $Q_{F_INJ}$ of fuel injected by the injectors 2 and the actual fuel flow rate of the high-pressure pump 4.

The threshold value is preferably determined in an experimental set up phase. The threshold value is continuously compared with the energy index I under stationary conditions of applied load, speed n of the heat engine and pressure target $P_{TARGET}$.

The threshold value is determined in such a way that, when the energy index I exceeds the threshold value, this indicates that the high-pressure pump 4 is working under conditions that are close to the triggering of cavitation phenomena. Therefore, when the electronic control unit 7 detects that the energy index I exceeds the threshold value, the electronic control unit 7 is designed to increase the minimum threshold $Q_{MIN}$ by a quantity $\Delta Q_{MIN}$ and to decrease the pressure target $P_{TARGET}$ in the common rail 3 by a quantity $\Delta P_{TARGET}$ and for a given amount of time.

According to a preferred variant, the quantity $\Delta P_{TARGET}$ is equal to at least 10 bar (the quantity $\Delta P_{TARGET}$ is independent of the difference between the energy index I and the respective threshold value). In case the energy index I remains greater than the respective threshold value, the quantity $\Delta P_{TARGET}$ is increased to 20 bar. The quantity $\Delta P_{TARGET}$ is increased by 10 bar as long as the energy index I does not go back to a value that is smaller than the respective threshold value.

Therefore, in this case, the minimum threshold $Q_{MIN}$ is calculated as follows:

$$Q_{MIN}=(1-K)*Q_{MIN_COLD}+K*Q_{MIN_HOT}+\Delta Q_{MIN} \quad [5]$$

$Q_{MIN}$ minimum threshold;

K coefficient;

$Q_{MIN_COLD}$ "cold" contribution of the minimum threshold;

$Q_{MIN_HOT}$ "hot" contribution of the minimum threshold; and $\Delta Q_{MIN}$ quantity.

Preferably, the quantity $\Delta Q_{MIN}$ is variable and at least equal to 20 mg (the quantity $\Delta Q_{MIN}$ is independent of the difference between the energy index I and the respective threshold value). In case the energy index I remains greater than the respective threshold value, the quantity $\Delta Q_{MIN}$ is increased to 40 mg. The quantity $\Delta Q_{MIN}$ is increased by 20 mg as long as the energy index I does not reach a value that is smaller than the respective threshold value.

Once the minimum threshold $Q_{MIN}$ has been calculated, the strategy entails controlling the high-pressure pump 4 based on said minimum threshold $Q_{MIN}$ so as to contain the temperature variation generated during the pumping phase in the high-pressure pump 4, increase energy efficiency and decrease potential damaging risks.

Figure 3:
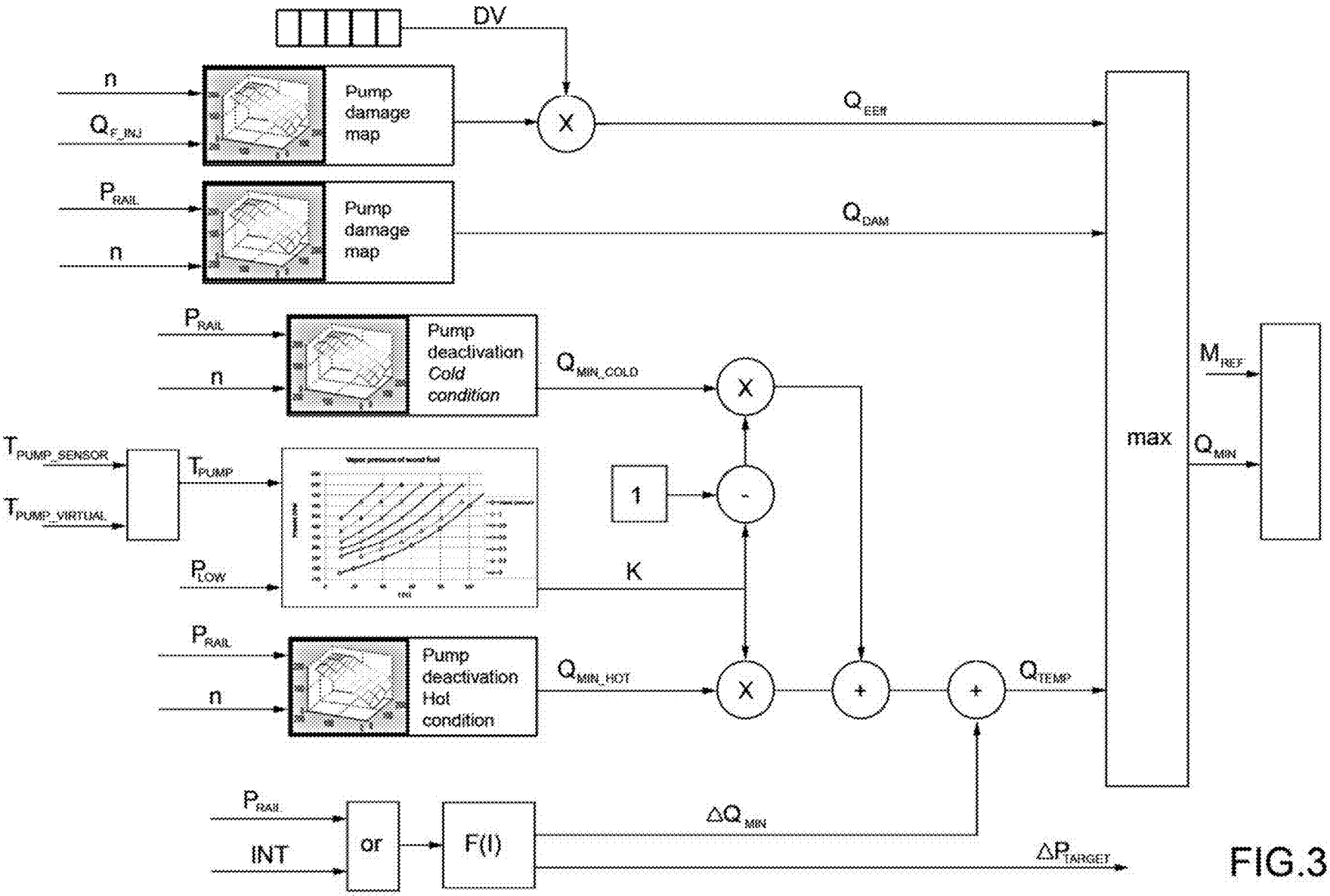
FIG. 3 is a block diagram showing a second variant of the operating logic of the method according to the invention.

According to a further variant shown in FIG. 3, the strategy entrails calculating a contribution $Q_{TEMP}$ to contain the temperature variation generated during the pumping phase in the high-pressure pump 4 according to the description above.

More in detail, inside the electronic control unit 7 there is stored a map COLD, which provides an (open loop) contribution $Q_{MIN_COLD}$ to determine the contribution $Q_{TEMP}$. The contribution $Q_{MIN_COLD}$ represents the minimum threshold of fluid to be pumped under cold conditions, i.e. under conditions that are far from the triggering of cavitation phenomena for given values of the pressure $P_{RAIL}$ in the common rail 3 and of the speed n of the heat engine 1. Indeed, the map COLD receives, as an input, the values of the pressure $P_{RAIL}$ in the common rail 3 and of the speed n of the heat engine 1, respectively, and, based on said input values, provides the contribution $Q_{MIN_COLD}$.

Similarly, inside the electronic control unit there is stored a further map HOT, which provides an (open loop) contribution $Q_{MIN_HOT}$ to determine the contribution $Q_{TEMP}$. The contribution $Q_{MIN_HOT}$ represents the minimum threshold of fluid to be pumped under hot conditions, i.e. under conditions that are close to the triggering of cavitation phenomena for given values of the pressure $P_{RAIL}$ in the common rail 3 and of the speed n of the heat engine 1.

Finally, inside the electronic control unit 7 there is stored a map VAPOR PRESSURE, which provides a coefficient K (expressed as percentage), which is also used to determine the contribution $Q_{TEMP}$. The map VAPOR PRESSURE receives, as an input, the values of the inlet pressure $P_{LOW}$ of the high-pressure pump 4 (also known as "low pressure") and of the temperature $T_{PUMP}$ of the high-pressure pump 4, respectively, the latter being expressed either by the temperature ($T_{PUMP_SENSOR}$) detected by means of the temperature sensor housed on the high-pressure pump 4 or by the temperature ($T_{PUMP_VIRTUAL}$) estimated by means of an estimation model. Said map VAPOR PRESSURE contains the curves of the fuel vapour pressure depending on the temperature $T_{PUMP}$ of the high-pressure pump 4. Based on the temperature $T_{PUMP}$ of the high-pressure pump 4 and on the inlet pressure $P_{LOW}$ of the high-pressure pump 4, the map VAPOR PRESSURE provides said coefficient K, which expresses (as a percentage) how far or close the high-pressure pump 4 is from or to the condition of triggering of cavitation phenomena.

Therefore, the contribution $Q_{TEMP}$ is calculated as follows:

$$Q_{TEMP}=(1-K)*Q_{MIN_COLD}+K*Q_{MIN_HOT} \quad [6]$$

$Q_{TEMP}$ contribution to contain the temperature variation generated during the pumping phase in the high-pressure pump 4.

K coefficient;

$Q_{MIN_COLD}$ "cold" contribution of the minimum threshold; and $Q_{MIN_HOT}$ "hot" contribution of the minimum threshold.

Or, alternatively, the contribution $Q_{TEMP}$ is calculated as follows:

$$Q_{TEMP}=(1-K)*Q_{MIN_COLD}+K*Q_{MIN_HOT}+\Delta Q_{MIN} \quad [7]$$

$Q_{TEMP}$ contribution to contain the temperature variation generated during the pumping phase in the high-pressure pump 4.

K coefficient;

$Q_{MIN_COLD}$ "cold" contribution of the minimum threshold;

$Q_{MIN_HOT}$ "hot" contribution of the minimum threshold; and $\Delta Q_{MIN}$ quantity.

Wherein the quantity $\Delta Q_{MIN}$ has the meaning described above, is variable and at least equal to 20 mg (the quantity $\Delta Q_{MIN}$ is independent of the difference between the energy index I and the respective threshold value). In case the energy index I remains greater than the respective threshold value, the quantity $\Delta Q_{MIN}$ is increased to 40 mg. The quantity $\Delta Q_{MIN}$ is increased by 20 mg as long as the energy index I does not reach a value that is smaller than the respective threshold value.

Furthermore, the strategy entails calculating a contribution $Q_{EEff}$ to increase energy efficiency and a further contribution $Q_{DAM}$ to decrease potential damaging risks.

More in detail, inside the electronic control unit 7 there is stored a map, which provides the (open loop) contribution $Q_{EEff}$ to increase energy efficiency in order to determine the minimum threshold $Q_{MIN}$. The contribution $Q_{EEff}$ represents the quantity of fluid to be pumped in order to optimize energy efficiency for given values of the pressure $P_{RAIL}$ in the common rail 3 and of the quantity $Q_{F_INJ}$ of fuel injected by the injectors 2. Indeed, the map receives, as an input, the values of the pressure $P_{RAIL}$ in the common rail 3 and of the quantity $Q_{F_INJ}$ of fuel injected by the injectors 2, respectively, and, based on said input values, provides the contribution $Q_{EEff}$.

The contribution $Q_{EEff}$ is preferably determined based on a driving mode DV chosen by the driver of the vehicle provided with the heat engine 1. Advantageously, the contribution $Q_{EEff}$ is determined (weighed) depending on the position of the hand lever identifying the driving/operating mode DV chosen by the driver from among a plurality of possible driving/operating modes DV; for example, the possible driving/operating modes DV comprise the sports driving/operating mode DV (which enhances performances), the normal driving/operating mode DV, the eco driving/operating mode DV (which enhances the reduction of consumptions), etc. Each possible driving/operating mode DV corresponds to a weight (determined during a preliminary set up phase).

Furthermore, inside the electronic control unit 7 there is stored a map, which provides the (open loop) contribution $Q_{DAM}$ to decrease potential damaging risks in order to determine the minimum threshold $Q_{MIN}$. The contribution $Q_{DAM}$ represents the minimum quantity of fluid to be pumped in order to decrease potential damaging risks for given values of the pressure $P_{RAIL}$ in the common rail 3 and of the speed n of the heat engine 1. Indeed, the map receives, as an input, the values of the pressure $P_{RAIL}$ in the common rail 3 and of the speed n of the heat engine 1, respectively, and, based on said input values, provides the contribution $Q_{DAM}$.

Finally, the minimum threshold $Q_{MIN}$ is calculated. Preferably, the minimum threshold $Q_{MIN}$ corresponds to the greatest one among the contribution $Q_{TEMP}$ to contain the temperature variation generated during the pumping phase in the high-pressure pump 4, the contribution $Q_{EEff}$ to increase energy efficiency and the contribution $Q_{DAM}$ to decrease potential damaging risks. Alternatively, the minimum threshold $Q_{MIN}$ corresponds to weighed mean of the contribution $Q_{TEMP}$ to contain the temperature variation generated during the pumping phase in the high-pressure pump 4, the contribution $Q_{EEff}$ to increase energy efficiency and the contribution $Q_{DAM}$ to decrease potential damaging risks.

Hence, the strategy entails calculating the objective fuel flow rate $M_{ref}$ to be fed by the high pressure pump 4 to the common rail 3 instant by instant in order to have the desired pressure value inside the common rail 3.

Then, the electronic control unit 7 is designed to compare the objective fuel flow rate $M_{ref}$ with the minimum threshold $Q_{MIN}$.

In case the objective fuel flow rate $M_{ref}$ is greater than (or equal to) the minimum threshold $Q_{MIN}$, the high-pressure pump 4 is controlled so as to deliver the objective fuel flow rate $M_{ref}$. On the contrary, in case the objective fuel flow rate $M_{ref}$ is smaller than the minimum threshold $Q_{MIN}$, the high-pressure pump 4 carries out an idle operating cycle of the high-pressure pump 4. In other words, in case the objective fuel flow rate $M_{ref}$ is smaller than the minimum threshold $Q_{MIN}$, the high-pressure pump 4 is not operated.

The control unit 7 is designed to adjust the flow rate of the high-pressure pump 4 so as to process objective fuel flow rates $M_{ref}$ which are greater than the minimum threshold $Q_{MIN}$. In other words, the control unit 7 is designed to control the alternation of operating cycles, in which the high-pressure pump 4 processes objective fuel flow rates $M_{ref}$ which are greater than the minimum threshold $Q_{MIN}$, and idle operating cycles.

Hence, the electronic control unit 7 is configured to control, with every activation cycle, the high-pressure pump 4 by means of a feedback control using, as feedback variables, the value of the fuel pressure inside the common rail 3, which is preferably detected in real time by the pressure sensor 11, and the comparison between the objective fuel flow rate $M_{ref}$ to be fed by the high-pressure pump 4 to the common rail 3 instant by instant in order to have the desired pressure value inside the common rail 3 and the minimum threshold $Q_{MIN}$, which is calculated according to formulas [1] or [5] described above.

The strategy implemented by the electronic control unit 7 to control the high-pressure pump 4 and described so far has some advantages.

In particular, even though it is advantageous in terms of costs, it is also easy and cheap to be implemented. In particular, the method described above does not involve an excessive computing burden for the electronic control unit 7 and, at the same time, allows manufacturers to avoid the triggering of cavitation phenomena, avoid damages to the high-pressure pump 4 and contain the temperature variation generated during the pumping phase in the high-pressure pump 4 as well as maintain the objective value of the fuel pressure inside the common rail 3.

The invention claimed is:

1. A method to control a fuel pump (4) for a direct injection system of a heat engine (1) provided with a common rail (3) comprising the steps of:

determining a minimum threshold ($Q_{MIN}$, $Q_{TEMP}$) of fuel to be fed by the high-pressure pump (4);

calculating the objective fuel flow rate ($M_{ref}$) to be fed by the high-pressure pump (4) to the common rail (3) instant by instant in order to have the desired pressure value ($P_{TARGET}$) inside the common rail (3);

comparing the objective fuel flow rate ($M_{ref}$) with the minimum threshold ($Q_{MIN}$, $Q_{TEMP}$); and controlling the high-pressure pump (4) based on the comparison between the objective fuel flow rate ($M_{ref}$) and the minimum threshold ($Q_{MIN}$, $Q_{TEMP}$);

the method is characterized in that the step of determining a minimum threshold ($Q_{MIN}$, $Q_{TEMP}$) comprises the sub-steps of:

determining a first contribution ($Q_{MIN_COLD}$) and a second contribution ($Q_{MIN_HOT}$) based on the pressure ($P_{RAIL}$) in the common rail (3) and on the speed (n) of the heat engine (1); wherein the first contribution ($Q_{MIN_COLD}$) is the minimum threshold of fluid to be pumped under cold conditions that are far from the triggering of cavitation phenomena for given values of the pressure ($P_{RAIL}$) in the common rail (3) and of the speed (n) of the heat engine (1), and the second contribution ($Q_{MIN_HOT}$) is the minimum threshold of fuel to be pumped under hot conditions that are close to the triggering of cavitation phenomena for given values of the pressure ($P_{RAIL}$) in the common rail (3) and of the speed (n) of the heat engine (1);

determining a coefficient (K) based on the temperature ($T_{PUMP}$) of the high-pressure pump (4) and on the inlet pressure ($P_{LOW}$) of the high-pressure pump (4); wherein said coefficient (K) expresses the closeness of the high-pressure pump (4) to the condition of triggering of cavitation phenomena; and determining said minimum threshold ($Q_{MIN}$, $Q_{TEMP}$) based on the first contribution ($Q_{MIN_COLD}$), on the second contribution ($Q_{MIN_HOT}$) and on the coefficient (K).

2. A method according to claim 1 and comprising the further steps of:

determining a third contribution ($Q_{EEff}$) to increase energy efficiency based on the pressure ($P_{RAIL}$) in the common rail (3) and on the injected fuel quantity ($Q_{F_INJ}$);

determining a fourth contribution ($Q_{DAM}$) to decrease possible risks of damaging the high-pressure pump (4) based on the pressure ($P_{RAIL}$) in the common rail (3) and on the speed (n) of the heat engine (1); and determining said minimum threshold ($Q_{MIN}$) based on the third contribution ($Q_{EEff}$) and on the fourth contribution ($Q_{DAM}$).

3. A method according to claim 2, wherein the third contribution ($Q_{EEff}$) is determined depending on a driving mode (DV) chosen for the vehicle provided with the heat engine (1); preferably, depending on the position of a hand lever among a plurality of possible positions.

4. A method according to claim 2 and comprising the further steps of:

determining a fifth contribution ($Q_{TEMP}$) to contain the temperature variation generated during the pumping phase in the high-pressure pump (4) based on the first contribution ($Q_{MIN_COLD}$), on the second contribution ($Q_{MIN_HOT}$) and on the coefficient (K); and determining said minimum threshold ($Q_{MIN}$) based on the comparison among the fifth contribution ($Q_{TEMP}$), the third contribution ($Q_{EEff}$) and the fourth contribution ($Q_{DAM}$).

5. A method according to claim 4, wherein the fifth contribution ($Q_{TEMP}$) is calculated as follows:

$$Q_{TEMP}=(1-K)*Q_{MIN_COLD}+K*Q_{MIN_HOT} \quad [6]$$

$Q_{TEMP}$ fifth contribution;

K coefficient;

$Q_{MIN_COLD}$ first contribution; and $Q_{MIN_HOT}$ second contribution.

6. A method according to claim 4, wherein the minimum threshold ($Q_{MIN}$) corresponds to the greatest value among the fifth contribution ($Q_{TEMP}$), the third contribution ($Q_{EEff}$) and the fourth contribution ($Q_{DAM}$).

7. A method according to claim 1 and comprising the further step of controlling the high-pressure pump (4) so as to deliver the objective fuel flow rate ($M_{ref}$) only in case the objective fuel flow rate ($M_{ref}$) is greater than the minimum threshold ($Q_{MIN}$, $Q_{TEMP}$); and controlling the high-pressure pump (4) so as not to deliver fuel in case the objective fuel flow rate ($M_{ref}$) is smaller than the minimum threshold ($Q_{MIN}$, $Q_{TEMP}$).

8. A method according to claim 1, wherein the step of determining a minimum threshold ($Q_{MIN}$, $Q_{TEMP}$) comprises the sub-steps of:

calculating an energy index (I), which gives an indication of the closeness—or lack thereof—to the triggering o cavitation phenomena in the high-pressure pump (4) based on the intensity of the perturbation of the signal concerning the pressure ($P_{RAIL}$) in the common rail (3) detected in real time by a pressure sensor (11), wherein the perturbation is assessed by means of an integral within an observation time window; and calculating the minimum threshold ($Q_{MIN}$, $Q_{TEMP}$) based on said energy index (I).

9. A method according to claim 8 and comprising the further step of decreasing the desired pressure value ($P_{TARGET}$) inside the common rail (3) by a first quantity ($\Delta P_{TARGET}$) and for a first amount of time in case the energy index (I) exceeds a first threshold value.

10. A method according to claim 9, wherein the first quantity ($\Delta P_{TARGET}$) is equal to at least 10 bar and preferably is independent of the difference between the energy index (I) and the first threshold value.

11. A method according to claim 8 and comprising the further step of increasing the minimum threshold ($Q_{MIN}$, $Q_{TEMP}$) by a second quantity ($\Delta Q_{MIN}$) in case the energy index (I) exceeds a first threshold value.

12. A method according to claim 11, wherein the second quantity ($\Delta Q_{MIN}$) is equal to at least 20 mg and preferably is independent of the difference between the energy index (I) and the first threshold value.

13. A method according to claim 8, wherein the energy index ($I_1$) in case the objective fuel flow rate ($M_{ref}$) is delivered is calculated as:

$$I_1=\int_{t_1}^{t_2}(P_{TARGET}-P_{RAIL})^2dt \quad [2]$$

wherein $t_1$, $t_2$ instants defining an observation time window;

$P_{RAIL}$ actual pressure in the common rail (3);

$P_{TARGET}$ desired pressure value in the common rail (3).

14. A method according to claim 8, wherein the energy index ($I_2$) in case the objective fuel flow rate ($M_{ref}$) is delivered is calculated as:

$$I_2=\int_{t_1}^{t_2}(P_{RAIL_M}-P_{RAIL})^2dt \quad [3]$$

wherein $t_1$, $t_2$ instants defining an observation time window;

$P_{RAIL}$ actual pressure in the common rail (3); and $P_{RAIL_M}$ actual mean pressure in the common rail (3) and within the observation window.

15. A method according to claim 8, wherein the energy index ($I_3$) is calculated as:

$$I_3=\int_{t_1}^{t_2}(INT_M-INT)^2dt \quad [4]$$

wherein:

$t_1$, $t_2$ instants defining an observation time window;

INT value of the integral component of the closed loop of the pressure control;

$INT_M$ mean value of the integral component of the closed loop of the pressure control within the observation window.

* * * * *